US005419679A

United States Patent [19]

Gaunt et al.

[11] Patent Number: 5,419,679

[45] Date of Patent: May 30, 1995

[54] LAMINAR FLOW FAN AND ELECTRICAL APPARATUS INCORPORATING FAN

[75] Inventors: David S. Gaunt, Southampton; Richard J. Coles, Ampfield; Ivor W. Bolton, Winchester, all of England

[73] Assignee: International Business Machines Corporation, Armonk, N.Y.

[21] Appl. No.: 109,193

[22] Filed: Aug. 19, 1993

[30] Foreign Application Priority Data

Aug. 20, 1992 [GB] United Kingdom ..... 9217738

[51] Int. Cl.[6] ..... F04D 17/16; F01D 1/36; H05K 7/20

[52] U.S. Cl. ..... 415/90; 415/218.1; 361/695

[58] Field of Search ..... 415/90, 218.1; 361/695

[56] References Cited

U.S. PATENT DOCUMENTS

| | | | |
|---|---|---|---|
| 2,087,834 | 7/1937 | Brown et al. | 415/90 |
| 2,632,598 | 3/1953 | Wales, Jr. . | |
| 2,998,099 | 8/1961 | Hollingsworth | 415/90 |
| 3,017,848 | 1/1962 | Bishop | 415/90 |
| 4,224,797 | 9/1980 | Kelly | 415/90 |
| 4,904,155 | 2/1990 | Nagaoka et al. | 415/90 |
| 5,000,079 | 3/1991 | Mardis | 361/695 |
| 5,192,183 | 3/1993 | Wilkinson | 415/90 |
| 5,210,680 | 5/1993 | Scheibler | 361/695 |

FOREIGN PATENT DOCUMENTS

| | | |
|---|---|---|
| 0474929 | 3/1992 | European Pat. Off. . |
| 2126653 | 3/1984 | United Kingdom . |
| WO90/15581 | 12/1990 | WIPO . |

*Primary Examiner*—Edward K. Look
*Assistant Examiner*—Michael S. Lee
*Attorney, Agent, or Firm*—Richard E. Billion; Roy W. Truelson

[57] ABSTRACT

A laminar flow fan is adapted to fit into a the internal cavity of a fan housing (70). The fan comprises a stack of parallel disk elements (12, 14, 16, 18, 20, 22) mounted for rotation on a motor (40) with the diameters of the disk elements varying within the stack to more fully utilize the available internal space of the housing. Apparatus which uses such a fan as part of its forced air cooling system is also described.

9 Claims, 2 Drawing Sheets

LAMINAR FLOW FAN AND ELECTRICAL APPARATUS INCORPORATING FAN

FIELD OF THE INVENTION

This invention relates to the field of laminar flow fans comprising a plurality of rotatable parallel disk elements and also to apparatus incorporating such fans.

BACKGROUND OF THE INVENTION

Laminar flow fans are commonly used for impelling a fluid medium (a liquid or gas). In particular, they are suited to low flow, high back pressure forced air;cooling of electrical apparatus when low acoustic fan noise is required. Typically, these fans comprised an assembly of parallel annular or frustro-conical elements, mounted in spaced apart relationship and face-to-face about a common rotation axis. In operation, the assembly is rotated about this axis by a suitable motor; the fluid is drawn in at the center of the assembly, impelled towards the outer edges of the elements by viscous interaction with the surface of the elements and, is finally expelled at the periphery of the assembly. Examples of laminar flow fans may be found in GB 2 126 653 and U.S. Pat. No. 2,632,598.

A large variety:of cooling systems have been proposed for providing efficient cooling of a number of electrical or electronic devices housed together in an enclosure. In many of today's computer system units, a number of different elements including mass storage devices, circuit cards and associated power supplies are provided which must be cooled sufficiently in order to ensure safe operating temperatures. The cooling system employed in such system units commonly comprises one or more axial flow fans placed at the rear of the unit which operate to draw cooling air through apertures in the front bezel of the unit, over the electrical devices and to expel exhaust air through apertures at the rear of the unit. One common type of system unit is the floor standing 'tower' in which a tower is supported in an upright position by a support foot.

While these cooling systems are undoubtedly adequate for the purpose, they have a number of drawbacks. Firstly, the fan take up valuable space within the unit which results in an increase in the overall size of the unit and secondly the noise produced by axial fans can be significant in an office environment.

SUMMARY OF THE INVENTION

The present invention seeks to improve on prior cooling systems and accordingly provides a laminar flow fan, adapted to fit into a predetermined housing, comprising a stack of parallel disk elements mounted for rotation by a motor; characterized in that the diameters of the disk elements vary within the stack so as to maximize utilization of the available internal space of the housing.

Thus when the predetermined housing is a shape such that full use of the internal space can not be achieved using a standard axial flow fan or laminar fan with equal diameter disk elements, the laminar flow fan of the present invention including varying 4 diameter disk elements achieves maximum utilization of the available space. For a given housing, a fan shaped according to the present invention can be shown to be more efficient than an axial flow fan in the same housing. In addition, tailoring of the disk element diameters according to the present invention results in an increase in the total surface area of the fan over non-tailored laminar flow fan thereby providing an increase in efficiency.

In a second aspect of the invention, there is provided an apparatus for housing and cooling one or more electrical devices comprising: a base; a chassis secured to the base in which chassis the one or more electrical devices are mountable; and a laminar flow fan of the type defined above which is being mounted within the base.

In this way, efficient cooling of the electrical devices is achievable without the cooling system taking up valuable space within the chassis. In addition, profiling the shape of the disk element stack of the laminar flow fan allows for the most efficient use of the available space within the base thus optimizing the fan efficiency for a particular shape of base cavity.

The form factor of a laminar flow fan is ideal for this design since the air is drawn through the central 'eye' of the disk elements and expelled radially through louvers in the base. In addition, laminar flow fans are quieter in general than other more commonly used types of fan.

BRIEF DESCRIPTION OF THE DRAWINGS

A preferred embodiment of the invention will now be described, by way of example only, with reference to the accompanying drawings in which.

DETAILED DESCRIPTION

Figure 1:
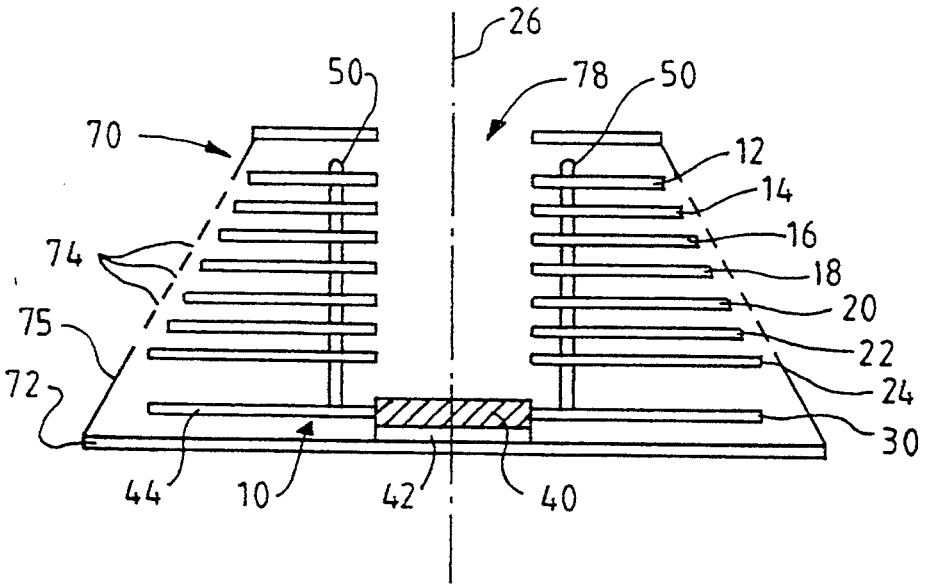
FIG. 1 is a schematic cross sectional view of a laminar flow fan according to the present invention.

FIG. 1 shows a laminar flow fan 10 comprising a plurality of disk elements 2, 14, 16, 18, 20, 22, 24, each having a central aperture, (13 in FIG. 2) which are held in a spaced apart relationship about a common rotation axis 26. In this description, the fan elements are shown as annular discs; however other element shapes e.g frustro-conical may be employed. The disks are commonly made of a plastics material, of the order of 1 mm in thickness and typically spaced by 0.5 to 3 mm in a fan used to impel air. However, the dimensions of all the fan components and element spacings depend on the performance required from the particular fan.

Figure 2:
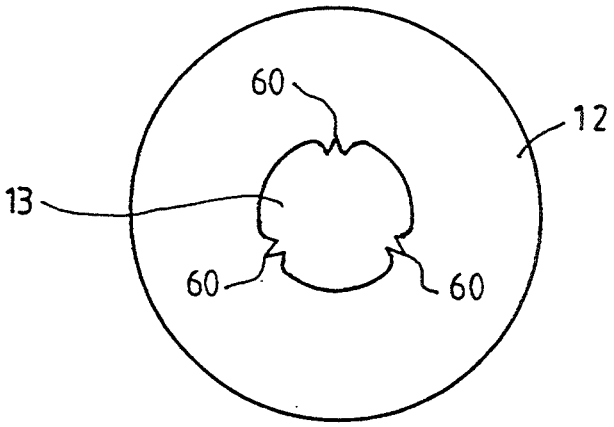
FIG. 2 is a top view of one disk element used in the laminar flow fan according to the present invention.

The plurality of disks is secured by means of three support posts (two of which are identified by reference numeral 50) to a non-apertured bottom plate 44 which is attached to and driven by rotor element 40 forming part of motor 42. FIG. 2 shows a single disk element including a central aperture incorporating three:notches 60 which engage with posts 50 to hold the disk element fixed in position. Further details of the laminar flow fan including the method of assembly may be found in European Patent 474 929. It ill however be appreciated that the exact construction of the laminar flow fan is not critical to the present invention.

A typical operational speed for this type of fan, when used to impel air, might be between several hundred and,perhaps three thousand revolutions per minute.

The fan is mounted within a hollow housing 70 by fixing the motor 42 to the inner surface of housing base plate 72. It can be seen in FIG. 1 that the housing is frustro-conical in cross section with the diameter of the disks making up the stack decreasing in a direction away from the bottom plate 44 such that the overall shape of the fan conforms closely to the cross section of the housing. Tailoring the disk diameters in this manner allows for a more efficient use of the internal volume of the housing than would be the case for a laminar flow fan made up of disks having a constant diameter equal to the diameter of the topmost disk in the fan of FIG. 1. Maximizing use of the internal volume of the housing using the present invention gives greater volume flow for a given speed than for the fan with constant diameter disks. Hence, it is possible to reduce the speed of the fan with a consequent reduction in noise while maintaining the required cooling efficiency. It will be appreciated that the disk diameters may readily be tailored to conform to housings with shapes different to that shown in FIG. 1.

Figure 3:
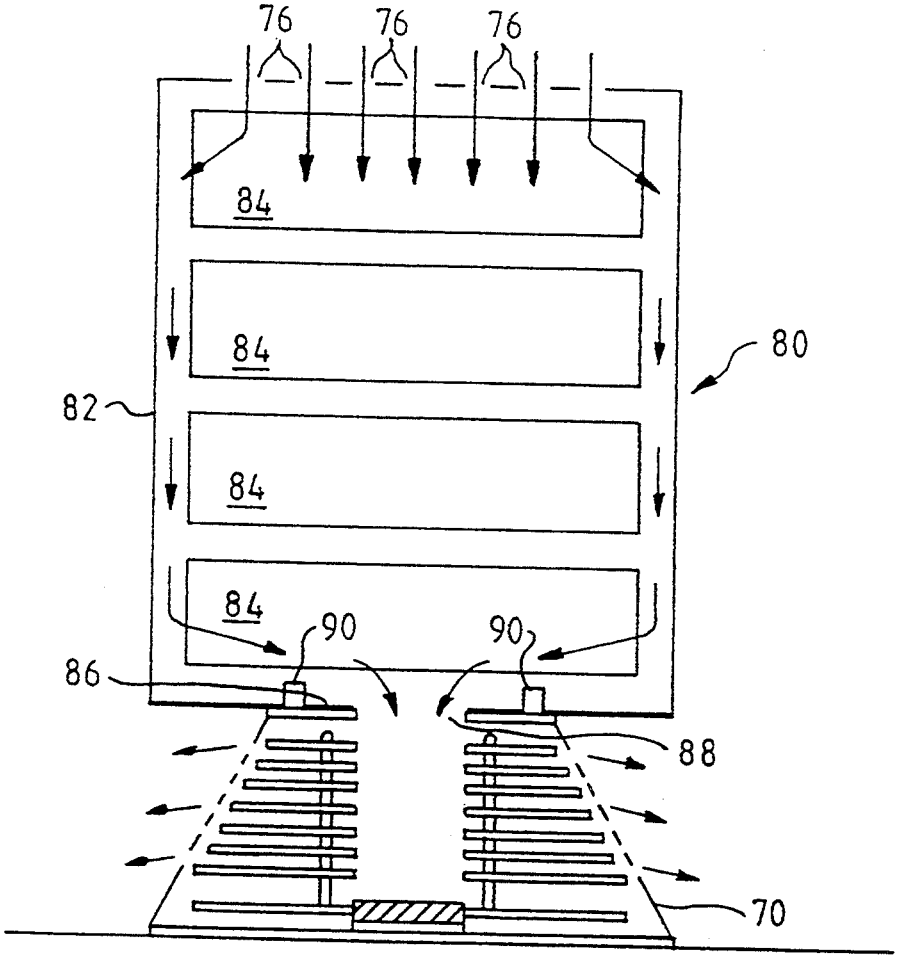
FIG. 3 is a schematic cross sectional view of an electrical apparatus housing incorporating the fan of FIG. 1.

FIG. 3 shows a tower unit 80 comprising a main chassis 82 attached to a base 70 in the form of a hollow foot pedestal shaped like the housing of FIG. 1. Mounted within the hollow foot pedestal is a laminar flow fan as depicted in FIG. 1. The tower chassis contains one or more electrical units 84, e.g., disk drives, power supplies, etc. and includes cooling apertures 76 in its top surface to permit intake of cooling air. An outlet aperture 88 in the lower surface 86 of the main chassis is aligned with a corresponding aperture (78 in FIG. 1) in the top of the foot pedestal to allow passage of cooling air from chassis to base. Included in the external wall 75 of the foot pedestal are a plurality of exhaust apertures 74, which are aligned with the edges of each of the disks.

In operation, air is drawn by the fan through the inlet apertures at the top of the chassis. This cooling air passes over the electrical units within the chassis and carries away heat produced by the units. As is well known in the cooling art, baffles (not shown) may be located at appropriate positions in the chassis in order to direct the flow of cooling air at specific portions of the units to be cooled, e.g., circuit boards. The heated air is then drawn through the outlet aperture of the chassis and into the central intake aperture of the fan. The air is turned through ninety degrees as it passes over the surfaces of the disks from which it is expelled via the outlet apertures in the foot pedestal into the external environment.

Figure 4:
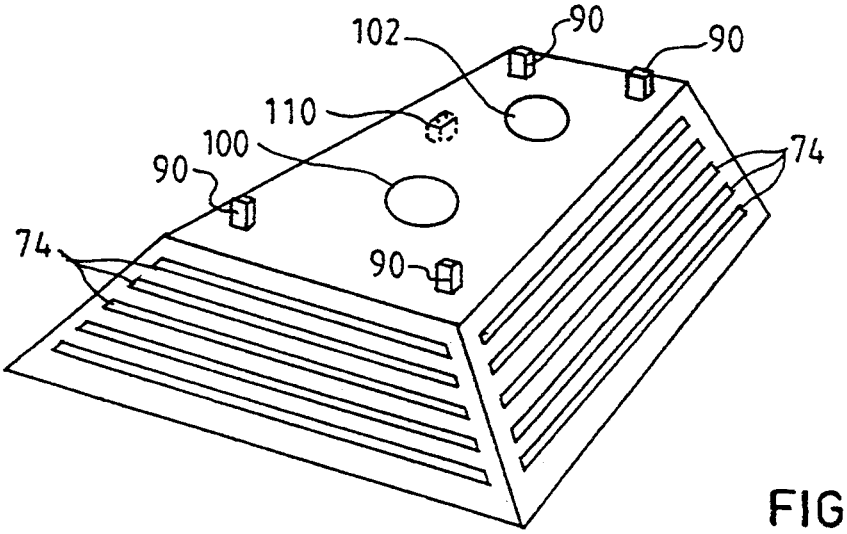
FIG. 4 is a schematic perspective view of a removable foot pedestal cooling assembly including a pair of laminar flow fans.

FIG. 4 shows a perspective schematic view of the foot pedestal assembly which is removably attachable to the main chassis of the tower unit. It can be seen that the top outer surface of the assembly includes a pair of apertures 100, 102 which communicate with the central intake apertures of a pair of laminar flow fans arranged side by side in the pedestal assembly. The lower surface of the chassis to which the pedestal of FIG. 4 is attachable will include s pair of outlet apertures corresponding to the pedestal inlet apertures.

Also included at each corner of the pedestal upper surface is a locating peg 90 which is positioned to mate with a corresponding aperture (not shown) on the chassis lower surface. A connector 110 is also provided on the pedestal upper surface via which power is supplied to the fan motors from a power supply in the chassis.

What is claimed is:

1. An apparatus for housing and cooling one or more electrical devices comprising:

a chassis secured to a cooling assembly enclosure in which chassis the one or more electrical devices are mountable; and a laminar flow fan mounted within said cooling assembly enclosure for cooling the devices, said laminar flow fan comprising:

(a) a motor; and (b) a stack of parallel spaced apart disk elements mounted for rotation about a common axis by said motor, wherein the diameters of the disk elements vary within the stack so as to maximize utilization of the available internal space of the cooling assembly enclosure, wherein the cooling assembly enclosure forms a base portion of the apparatus on which the chassis is supported, the cross sectional area of the available internal space in the base portion increasing away from the contact with the chassis with the diameter of the disk elements making up the stack increasing away from the chassis contact.

2. An apparatus for housing and cooling one or more electrical devices comprising:

a chassis secured to a cooling assembly enclosure in which chassis the one or more electrical devices are mountable; and a laminar flow fan mounted within said cooling assembly enclosure for cooling the devices, said laminar flow fan comprising:

(a) a motor; and (b) a stack of parallel spaced apart disk elements mounted for rotation about a common axis by said motor, wherein the diameters of the disk elements vary within the stack so as to maximize utilization of the available internal space of the cooling assembly enclosure, wherein the stack of rotatable disk elements mounted for rotation on said motor includes a central intake aperture for receiving cooling air from the chassis, wherein the cooling assembly enclosure forms a base portion of the apparatus on which the chassis is supported, the base portion including exhaust apertures through which cooling air is expelled radially from the disk elements.

3. An apparatus for housing and cooling one or more electrical devices comprising:

a chassis secured to a cooling assembly enclosure in which chassis the one or more electrical devices are mountable; and a laminar flow fan mounted within said cooling assembly enclosure for cooling the devices, said laminar flow fan comprising:

(a) a motor; and (b) a stack of parallel spaced apart disk elements mounted for rotation about a common axis by said motor, wherein the diameters of the disk elements vary within the stack so as to maximize utilization of the available internal space of the cooling assembly enclosure, wherein the cooling assembly enclosure forms a base portion of the apparatus on which the chassis is supported, wherein the base and laminar flow fan are a removable cooling assembly including power connector means for attaching to a corresponding connector on the chassis to provide power to the fan.

4. A laminar flow fan, adapted to fit into a predetermined housing, comprising:

a motor; and a stack of parallel spaced apart disk elements mounted for rotation about a common axis by said motor, wherein the diameters of each of the disk elements vary within the stack to conform to the shape of the housing so as to maximize utilization of the available internal space of the housing.

5. A laminar flow fan as claimed in claim 4 wherein the diameters of the disk elements vary from a disk element positioned at one end of the stack to a disk element positioned at the other end of the stack.

6. An apparatus for housing and cooling one or more electrical devices comprising:

a chassis secured to a cooling assembly enclosure in which chassis the one or more electrical devices are mountable; and a laminar flow fan mounted within said cooling assembly enclosure for cooling the devices, said laminar flow fan comprising:

(a) a motor; and (b) a stack of parallel spaced apart disk elements mounted for rotation about a common axis by said motor, wherein the diameters of the disk elements vary within the stack to conform to the shape of said cooling assembly enclosure so as to maximize utilization of the available internal space of the cooling assembly enclosure.

7. The apparatus for housing and cooling electrical devices of claim 6, wherein the diameters of the disk elements vary from a disk element positioned at one end of the stack to a disk element positioned at the other end of the stack.

8. The apparatus for housing and cooling electrical devices of claim 6, wherein the cooling assembly enclosure forms a base portion of the apparatus on which the chassis is supported.

9. The apparatus for housing and cooling electrical devices of claim 8, wherein at least two laminar flow fans are mounted side by side in the base.

* * * * *